US010278884B1

(12) United States Patent
Gingras et al.

(10) Patent No.: US 10,278,884 B1
(45) Date of Patent: May 7, 2019

(54) AMBULATORY ASSISTANCE APPARATUS ADAPTABLE FOR A STAIRCASE

(71) Applicants: Matthew Gingras, Middletown, CT (US); Joshua Sigsworth, Abington, MA (US); Mark Brodie, Hingham, MA (US)

(72) Inventors: Matthew Gingras, Middletown, CT (US); Joshua Sigsworth, Abington, MA (US); Mark Brodie, Hingham, MA (US)

( * ) Notice: Subject to any disclaimer, the term of this patent is extended or adjusted under 35 U.S.C. 154(b) by 0 days.

(21) Appl. No.: 16/188,416

(22) Filed: Nov. 13, 2018

(51) Int. Cl.
*A61H 3/00* (2006.01)
*A61H 3/04* (2006.01)

(52) U.S. Cl.
CPC ..... *A61H 3/00* (2013.01); *A61H 3/04* (2013.01); *A61H 2003/001* (2013.01)

(58) Field of Classification Search
CPC ..... A61H 2003/001; A61H 3/04
See application file for complete search history.

(56) References Cited

U.S. PATENT DOCUMENTS 3,387,618 A * 6/1968 Swann ..... A61H 3/02 135/67
4,941,496 A * 7/1990 Berning ..... A61H 3/04 135/67
6,338,493 B1 * 1/2002 Wohlgemuth ..... A61G 5/00 135/66
7,779,850 B2 * 8/2010 Caldwell ..... A61H 3/04 135/66
9,707,149 B1 * 7/2017 Juarez ..... A43B 5/0419
9,839,570 B2 * 12/2017 O'Sullivan ..... A61H 3/04
10,092,475 B2 * 10/2018 Smith ..... A61H 3/02

* cited by examiner

*Primary Examiner* — Noah Chandler Hawk
(74) *Attorney, Agent, or Firm* — Gulf Coast Intellectual Property Group

(57) ABSTRACT

An ambulatory assistance apparatus operable to assist a user traverse a flat surface and further being configured to have adaptive movement techniques to facilitate assisting a user ascend a staircase. The ambulatory assistance apparatus includes a frame having a left support assembly and a right support assembly with cross members intermediate thereto. A front leg assembly is provided and is secured to the lower front portion of the frame. The front leg assembly is movable in a first adaptive movement technique and a second adaptive movement technique. In the first adaptive movement technique the front leg assembly moves in an upward/downward direction. In the second adaptive movement technique the front leg assembly is pivotally movable. A coupling member is present to control in conjunction with a cable the second adaptive movement technique. A biasing member is present to provide the first adaptive movement technique.

18 Claims, 4 Drawing Sheets

AMBULATORY ASSISTANCE APPARATUS ADAPTABLE FOR A STAIRCASE

FIELD OF THE INVENTION

The present invention relates generally to ambulatory assistance for individuals, more specifically but not by way of limitation, an ambulatory assistance apparatus that is configured to assist a user in traversing across a desired surface and is further configured to be adaptable to engage a staircase so as to aid a user in ascending and/or descending a staircase.

BACKGROUND

Many individuals have trouble walking either due to a procedure or as a result of chronic injuries/conditions. There are various types of devices that are utilized in the field to provide assistance for a user in aiding them to walk. Devices such as but not limited to canes, crutches and wheeled devices are known in the art and utilized to a assist a user in walking. While these types of devices are reasonably effective at assisting a user in walking across a flat surface, they are not equipped to assist a user in walking on other surfaces such as but not limited to stairs. Some individuals require more balance assistance and as such it is common for these individuals to utilize devices such as walkers. Conventional walkers have a frame that provides four points of contact around a user so as to ensure the stability of a user during use thereof.

One issue with conventional walkers is the ability to accommodate stairs. The frames of conventional walkers typically have four legs wherein each leg is the same length. Some models provide wheels on two of the four legs to assist in the ease of moving the walker during utilization thereof. Conventional walkers cannot be configured to accommodate adjacent stair treads. When attempting to utilize a conventional walker to ascend a staircase the front legs are on a tread that is higher than the tread of the stair on which the rear legs are superposed. This results in an unstable platform and renders these conventional walkers inoperable to assist a user to ascend a staircase.

Accordingly, there is a need for an ambulatory assistance apparatus that is configurable to assist a user in traversing across a flat surface as well as being adaptable to engage a staircase so as to provide a level interface when ascending and/or descending the staircase.

SUMMARY OF THE INVENTION

It is the object of the present invention to provide an ambulatory assistance apparatus to assist a user in walking wherein the ambulatory assistance apparatus is configurable between a first position and a second position.

Another object of the present invention is to provide an ambulatory assistance apparatus operable to assist a user wherein the first position thereof is operable to assist a user traverse a flat surface.

A further object of the present invention is to provide an ambulatory assistance apparatus to assist a user in walking wherein in the second position of the apparatus it is configured to assist a user in ascending and/or descending a staircase.

Still another object of the present invention is to provide an ambulatory assistance apparatus operable to assist a user wherein the apparatus includes a frame having a plurality of support members configured to provide a stable interface for a user.

An additional object of the present invention is to provide an ambulatory assistance apparatus to assist a user in walking wherein the frame includes front leg members and rear leg members.

Yet a further object of the present invention is to provide an ambulatory assistance apparatus operable to assist a user wherein the front legs are movable utilizing a first technique and a second technique wherein each technique is operable to configure the ambulatory assistance apparatus to ascend a staircase.

Another object of the present invention is to provide an ambulatory assistance apparatus to assist a user in walking wherein the apparatus includes a biasing member operable to provide movement of a lower portion of the front legs in order to facilitate the positioning thereof to accommodate a staircase.

An alternate object of the present invention is to provide an ambulatory assistance apparatus operable to assist a user traversing a staircase wherein the second technique for moving the front leg members includes moving a lower portion thereof pivotally so as to be perpendicular with the upper portion of the front leg members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
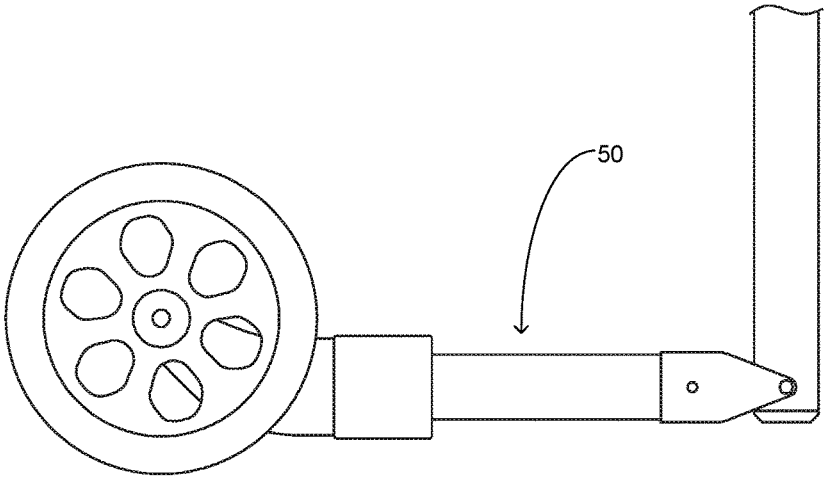
FIG. 1 is a detailed view of a lower portion of the front leg member of the present invention.

Referring now to the drawings submitted herewith, wherein various elements depicted therein are not necessarily drawn to scale and wherein through the views and figures like elements are referenced with identical reference numerals, there is illustrated an ambulatory assistance apparatus 100 constructed according to the principles of the present invention.

An embodiment of the present invention is discussed herein with reference to the figures submitted herewith.

Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
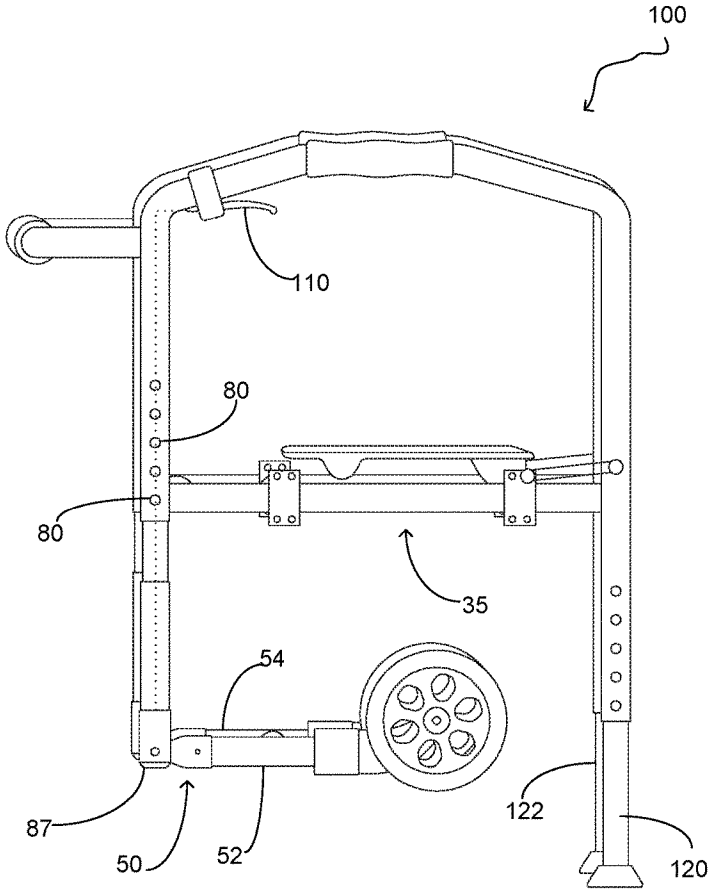
FIG. 3 is a side view of an embodiment of the present invention wherein the front leg members have been moved utilizing a second adaptive technique.
Figure 5:
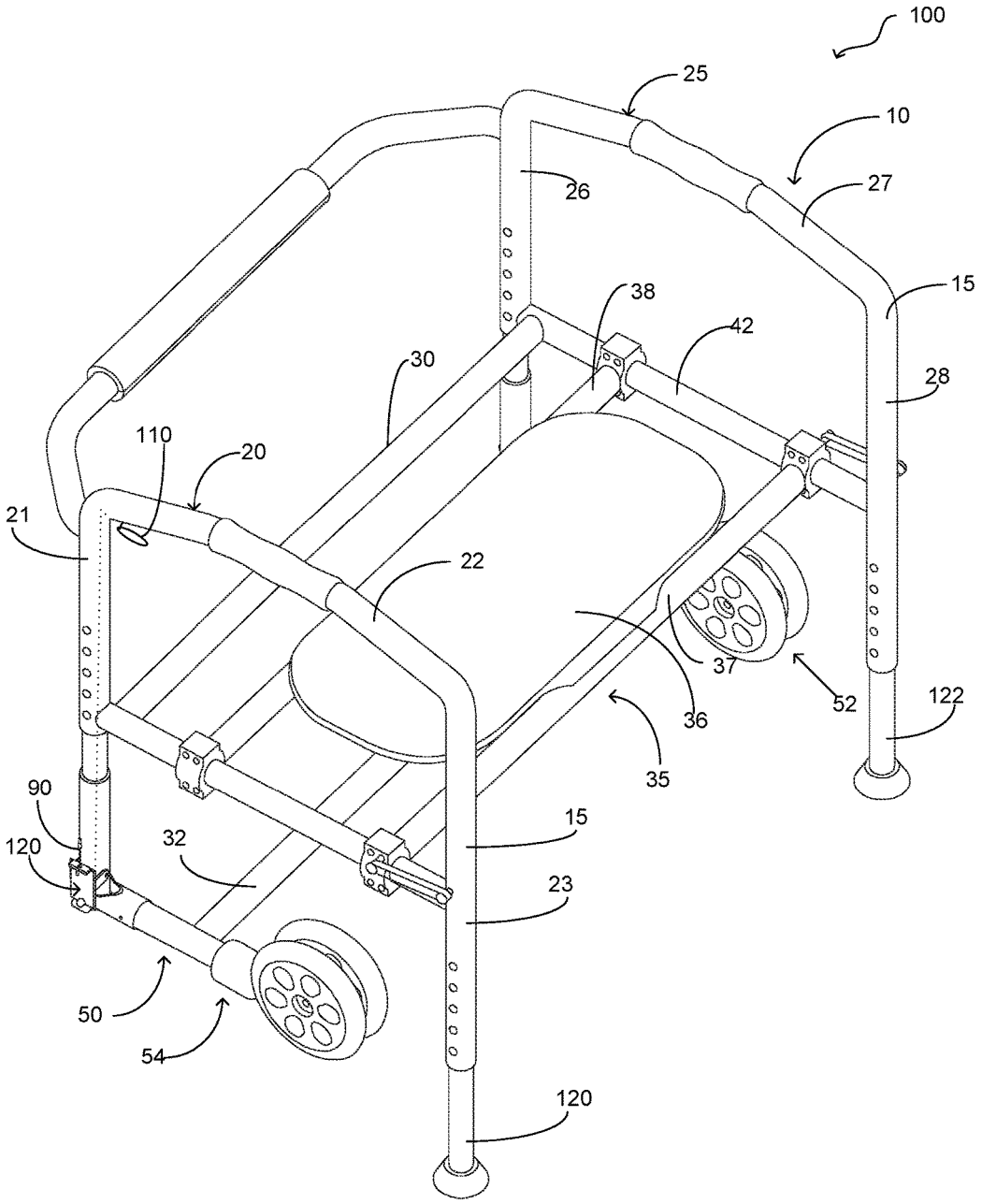
FIG. 5 is a perspective view of the present invention.

Referring in particular to FIG. 3 herein, the ambulatory assistance apparatus 100 includes a frame 10. The frame 10 includes a plurality of support members 15 that are operably coupled to form the receiving area 17 wherein the receiving area 17 is of suitable size to accommodate a human body during utilization of the ambulatory assistance apparatus 100. The support members 15 are manufactured from a suitable durable material such as but not limited to metal tubing. The frame 10 includes a left support assembly 20 and a right support assembly 25. The left support assembly 20 includes a first section 21, a second section 22 and a third section 23 that are contiguously formed to create the shape of the left support assembly 20. The first section 21 and third section 23 extend downward from the second section 22 on opposing ends thereof. The left support assembly 20 is generally u-shaped but it is contemplated within the scope of the present invention that the left support assembly 20 could be formed in alternate shapes and execute the desired function. The right support assembly 25 is built similarly to the left support assembly 20 being comprised of a first section 26, a second section 27 and a third section 28. The right support assembly 25 is formed in a similar shape as the left support assembly 20. While the ambulatory assistance apparatus 100 is illustrated herein as having four leg members it is contemplated within the scope of the present invention that the ambulatory assistance apparatus 100 could have more or less than four leg members.

The frame 10 includes an upper cross support member 30 and a lower cross support member 32 mounted intermediate the right support assembly 25 and the left support assembly 20. The upper cross support member 30 and lower cross support member 32 function to provide structural support for the frame 10. It is contemplated within the scope of the present invention that the ambulatory assistance apparatus 100 could have alternate quantities of cross support members in order to achieve the desired functionality described herein. Mounted within the receiving area 17 is seat assembly 35. Seat assembly 35 is configured to receive a user in a seated position during use of the ambulatory assistance apparatus 100. The seat assembly 35 includes a seat member 36 and seat support members 37, 38. The seat assembly 35 is slidably mounted to the left rail member 40 and right rail member 42. While the ambulatory assistance apparatus 100 is illustrated herein as having a seat assembly 35, it is contemplated within the scope of the present invention that the ambulatory assistance apparatus 100 could be manufactured without the seat assembly 35.

Figure 2:
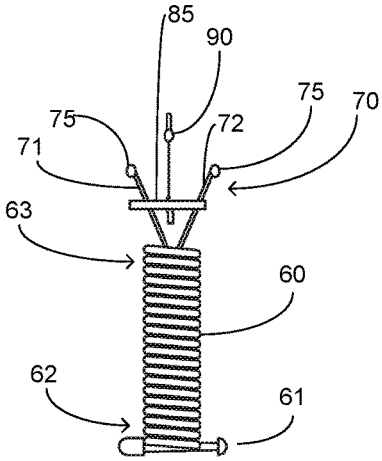
FIG. 2 is a detailed view of the biasing member of the present invention operable to provide the first adaptive movement technique.

The left support assembly 20 and right support assembly 25 have a front leg assembly 50 operably coupled thereto. The front leg assembly 50 includes a right leg member 52 and a left leg member 54. The front leg assembly 50 includes a lower cross support member 32. The lower cross support member 32 is coupled intermediate the right leg member 52 and left leg member 54 utilizing suitable techniques and is manufactured of the same tubing as the ambulatory assistance apparatus 100. The front leg assembly 50 as previously referenced herein is movable in a first adaptive movement technique and a second adaptive movement technique. Both the first adaptive movement technique and the second adaptive movement technique are operable to configure the ambulatory assistance apparatus 100 to ascend a staircase. The components to facilitate the first adaptive movement technique are illustrated herein in FIGS. 2 and 4. In the first adaptive movement technique the right leg member 52 and left leg member 54 are operable to move in an upwards-downwards motion so as to facilitate the proper height adjustment in order to ensure the ambulatory assistance apparatus 100 is level when superposed adjacent treads of a staircase.

Figure 4:
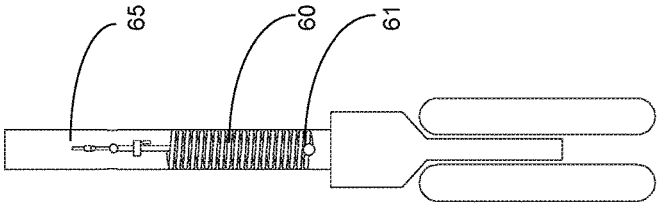
FIG. 4 is a detailed view of the lower portion of a front leg member illustrating the biasing member operable to provide the first adaptive movement technique.

Disposed within the interior volume of the right leg member 52 and left leg member 54 is a biasing member 60 illustrated herein in FIG. 4. The biasing member 60 is movable intermediate a compressed and extended position. The biasing member 60 is illustrated herein as a coil spring but it is contemplated within the scope of the present invention that the biasing member 60 could be manufactured from alternate elements. The biasing member 60 includes a retaining pin 61 wherein the retaining pin 61 is operable to maintain the first end 62 of the biasing member 60 in a fixed position within leg tube member 65. Operably coupled to the second end 63 of the biasing member 60 is a v-pin 70. The v-pin 70 includes a first portion 71 and a second portion 72 that are opposedly biased. Formed on the ends of the first portion 71 and second portion 72 of the v-pin 70 are engagement knobs 75. The engagement knobs 75 are operable to engage apertures 80. Movably coupled to the v-pin 70 is collar member 85. Collar member 85 is surroundably mounted to the first portion 71 and second portion 72 of the v-pin 70 and is manufactured from a durable rigid material such as but not limited to metal. The collar member 85 facilitates the release and engagement of the engagement knobs 75 with the apertures 80. The collar member 85 is secured to cable 90. The cable 90 is configured to move in an upwards/downwards manner and is controlled by lever 110. Manipulation of the lever 110 alters the tension on the cable 90 thus resulting in an upward or downward movement of the collar member 85. As the collar member 85 moves upward the first portion 71 and second portion 72 of the v-pin 70 are biased towards each other. The aforementioned movement of the v-pin 70 disengages the engagement knobs 75 from the apertures 80. When the engagement knobs 75 are disengaged from the apertures 80 a user can move the right leg member 52 and left leg member 54 in an upwards-downwards movement so as to facilitate the desired position for the front leg assembly 50 as need for superposing the ambulatory assistance apparatus 100 on a staircase wherein the front leg assembly 50 is superposed a tread that is higher than that of the tread on which the rear leg members 120,122 are superposed and the ambulatory assistance apparatus 100 is in a level orientation. It is contemplated within the scope of the present invention that the ambulatory assistance apparatus 100 could employ a single lever 110 or utilize two levers. It is further contemplated within the scope of the present invention that the ambulatory assistance apparatus 100 could include one biasing member 60 or two or more biasing members to facilitate the operation of the ambulatory assistance apparatus 100 and specifically the first adaptive movement technique thereof.

Figure 6:
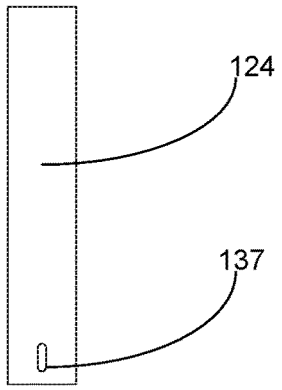
FIG. 6 is a detailed view of a lower portion of the front leg members.
Figure 7:
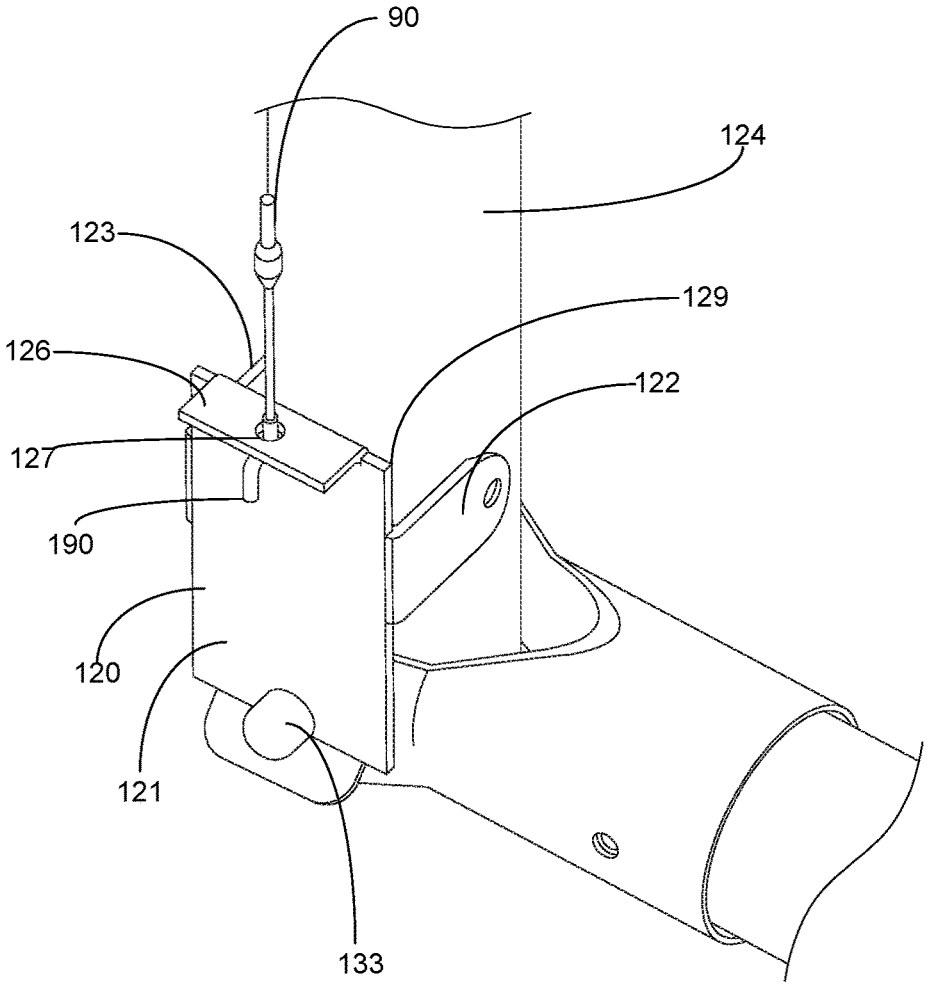
FIG. 7 is a detailed view of the operable connection of the front leg member configured for the second adaptive movement technique.

As previously referenced herein, the front leg assembly 50 is movable in a second adaptive movement technique in order to facilitate the ambulatory assistance apparatus 100 being superposed a staircase wherein the ambulatory assistance apparatus 100 is level in orientation. FIGS. 3,6 and 7 illustrate the ambulatory assistance apparatus 100 and in particular elements thereof that facilitate the movement of the front leg assembly 50 in its second adaptive movement technique. The second adaptive movement technique provides a ninety-degree pivotal movement of the front leg assembly 50 in order to promote engagement of stair treads by end member 87. While ninety degrees is a desired movement amount for the second adaptive movement technique, it is contemplated within the scope of the present invention that the second adaptive movement technique could be of alternate travel distances and/or angles. It should be understood that the right support assembly 25 includes an identical member but it is not visible in the illustrations submitted herewith. The pivotal movement of the front leg assembly 50 is operably controlled by coupling member 120. The coupling member 120 is pivotally coupled to the lower portion 124 of the first section 21 of the left support assembly 20. The coupling member 120 includes a planar body 121 having a first wing member 122 and a second wing member 123 that are pivotally mounted to the lower portion 124. The body 121 has formed proximate the top thereof connection member 126. Connection member 126 extends outward from the body 121 and is perpendicular thereto. The connection member 126 further includes an aperture 127 that is centrally located thereon and is configured to receive the end 190 of cable 90. Cable 90 is operably coupled to lever 110. As a user engages the lever 110 the cable 90 moves the coupling member 120 such that the top edge 129 pivots towards the lower portion 124 and as such releasing the pin 140 from the body 120. Pin 133 travels within oval aperture 137 and ensuing release from the coupling member 120 the front leg assembly 50 is movable to its second position illustrated herein in FIG. 3. It is contemplated within the scope of the present invention that the ambulatory assistance apparatus 100 could employ alternate styles of coupling members 120 in order to achieve the desired functionality of providing a second adaptive movement technique for the ambulatory assistance apparatus 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An ambulatory assistance apparatus configured to assist a user traverse a flat surface and a staircase comprising:

a frame, said frame further including a left support assembly and a right support assembly, said left support assembly and said right support assembly having a lower front section, said frame being manufactured from a lightweight rigid material, said frame having an upper cross member, said upper cross member extending intermediate said left support assembly and said right support assembly, said frame further having a front leg assembly and a rear leg assembly, said front leg assembly further including at least one biasing member, said at least one biasing member mounted internally in said front leg assembly, said at least one biasing member having a first end and a second end, said front leg assembly operably coupled to said lower front section; and wherein said front leg assembly is configured to be movable in a first adaptive movement technique and a second adaptive movement technique wherein in the second adaptive movement technique the front leg assembly is operable to be pivoted towards the rear leg member and wherein in said second adaptive movement technique said front leg assembly is operable to be moved in an upwards/downwards movement so as to superpose a tread of a staircase that is higher that than of a tread on which the rear leg assembly is superposed.

2. The ambulatory assistance apparatus as recited in claim 1, wherein said biasing member includes a v-pin operably coupled to the second end thereof, said v-pin having ends configured to engage apertures formed in the lower front section of the right support assembly or the left support assembly.

3. The ambulatory assistance apparatus as recited in claim 2, wherein said v-pin further includes a collar member surroundably mounted thereto, said collar member configured to be slidably coupled to said v-pin.

4. The ambulatory assistance apparatus as recited in claim 3, and further including a cable, said cable operably coupled to said collar member mounted to said v-pin, said cable configured to move said collar member in an upward direction along said v-pin.

5. The ambulatory assistance apparatus as recited in claim 1, and further including a coupling member said coupling member mounted intermediate said lower front section and said front leg assembly, said coupling member being pivotally mounted and having a release pin engaging therewith.

6. An ambulatory assistance apparatus configured to assist a user in walking across a flat surface and further being configured to assist a user ascend a staircase wherein the ambulatory assistance apparatus is maintained in a level orientation while engaged with the staircase comprising:

a frame, said frame further including a left support assembly and a right support assembly, said left support assembly and said right support assembly each having a lower front section, said frame being manufactured from a lightweight rigid material;

an upper cross member, said upper cross member extending intermediate said left support assembly and said right support assembly, said upper cross member providing structural support for said frame;

a first rear leg member and a second rear leg member, said first rear leg member being coupled to said left support assembly and second rear leg member being coupled to said right support assembly;

a front leg assembly, said front leg assembly operably coupled to said lower front section of said left support assembly and said right support assembly, said front leg assembly including a right leg member and a left leg member, said right leg member and said left leg member having a lower cross support member mounted intermediate thereto, said front leg assembly being configured to be movable in a first adaptive movement technique and a second adaptive movement technique wherein in the first adaptive movement technique the front leg assembly is operable to be moved in an upwards/downwards movement as required to engage a tread of a staircase that is higher that than of a tread on which the first rear leg member and a second rear leg member are superposed; and at least one biasing member, said at least one biasing member being disposed within said front leg assembly, said at least one biasing member having a first end and a second end, said first end of at least one biasing member being immovably secured within said front leg assembly.

7. The ambulatory assistance apparatus as recited in claim 6, wherein said at least one biasing member further includes a v-pin, said v-pin being secured to said second end of said at least one biasing member and extends outward therefrom, said v-pin having a first portion and a second portion biasly extending away from each other, said first portion and said second portion of said v-pin having ends configured to engage apertures in said lower front section of said frame.

8. The ambulatory assistance apparatus as recited in claim 7, and further including a collar member, said collar member being surroundably mounted said v-pin, said collar member configured to slidably engage said v-pin in order to bias said first portion and said second portion of said v-pin inwards so as to disengage the ends of the first portion and second portion from said apertures.

9. The ambulatory assistance apparatus as recited in claim 6, wherein in said second adaptive movement technique said front leg assembly is pivotably movable towards the first rear leg member and a second rear leg member so as to allow ends of the lower front section to be superposed a tread of a staircase.

10. The ambulatory assistance apparatus as recited in claim 9, and further including a coupling member, said coupling member operably coupled intermediate said front leg assembly and said lower front section of said frame, said coupling member being pivotally movable to facilitate release of a pin so as to facilitate said second adaptive movement technique.

11. The ambulatory assistance apparatus as recited in claim 10, wherein said coupling member further includes a first wing member and a second wing member opposedly secured to said lower front section, said first wing member and said second wing member pivotally secured to said lower front section.

12. The ambulatory assistance apparatus as recited in claim 11, said coupling member further including a connection member, said connection member being operably coupled to a cable, said cable configured to control pivotal movement of said coupling member so as to provide the second adaptive movement technique.

13. An ambulatory assistance apparatus configured to assist a user in walking across a flat surface and further being configured to assist a user ascend a staircase wherein the ambulatory assistance apparatus is maintained in a level orientation while engaged with the staircase comprising:

a frame, said frame further including a left support assembly and a right support assembly, said left support assembly and said right support assembly each having a lower front section, said frame being manufactured from a lightweight rigid material;

an upper cross member, said upper cross member extending intermediate said left support assembly and said right support assembly, said upper cross member providing structural support for said frame;

a first rear leg member and a second rear leg member, said first rear leg member being coupled to said left support assembly and second rear leg member being coupled to said right support assembly;

a front leg assembly, said front leg assembly operably coupled to said lower front section of said left support assembly and said right support assembly, said front leg assembly including a right leg member and a left leg member, said right leg member and said left leg member having a lower cross support member mounted intermediate thereto, said front leg assembly being configured to be movable in a first adaptive movement technique and a second adaptive movement technique wherein in the second adaptive movement technique the front leg assembly is operable to be moved in a pivotal movement towards the first rear leg member and second rear leg member as required to engage the lower front section with a tread of a staircase that is higher that than of a tread on which the first rear leg member and a second rear leg member are superposed; and a coupling member, said coupling member being operably secured intermediate said front leg assembly and said front leg assembly, said coupling member having a planar body, said coupling member having a first wing member and a second wing member opposedly secured to said body and extending towards said lower front section and pivotally secured thereto.

14. The ambulatory assistance apparatus as recited in claim 13, wherein the coupling member further includes a release pin operably coupled therewith, said release pin configured to maintain the front leg assembly in its first position wherein the front leg position is axially aligned with the lower front section.

15. The ambulatory assistance apparatus as recited in claim 14, wherein said coupling member further includes a connection member, said connection member configured to facilitate an operable connection with a cable, said cable being utilized to pivotally move said coupling member so as to allow the front leg assembly to be pivotally moved rearwards.

16. The ambulatory assistance apparatus as recited in claim 13, and further including at least one biasing member, said at least one biasing member being disposed within said front leg assembly, said at least one biasing member having a first end and a second end, said first end of at least one biasing member being immovably secured within said front leg assembly.

17. The ambulatory assistance apparatus as recited in claim 16, wherein said at least one biasing member further includes a v-pin, said v-pin being secured to said second end of said at least one biasing member and extends outward therefrom, said v-pin having a first portion and a second portion biasly extending away from each other, said first portion and said second portion of said v-pin having ends configured to engage apertures in said lower front section of said frame.

18. The ambulatory assistance apparatus as recited in claim 17, and further including a collar member, said collar member being surroundably mounted said v-pin, said collar member configured to slidably engage said v-pin in order to bias said first portion and said second portion of said v-pin inwards so as to disengage the ends of the first portion and second portion from said apertures.

* * * * *